United States Patent [19]

Ojanen

[11] Patent Number: 4,497,520

[45] Date of Patent: Feb. 5, 1985

[54] ROTATABLE CUTTING BIT

[75] Inventor: Randall W. Ojanen, Bristol, Va.

[73] Assignee: GTE Products Corporation, Stamford, Conn.

[21] Appl. No.: 489,990

[22] Filed: Apr. 29, 1983

[51] Int. Cl.[3] ..... E21C 35/18

[52] U.S. Cl. ..... 299/86; 175/410

[58] Field of Search ..... 299/86; 175/410; 172/717, 713, 747; 76/108, DIG. 11; 407/32, 118, 119

[56] References Cited

U.S. PATENT DOCUMENTS

| | | | |
|---|---|---|---|
| 3,957,307 | 5/1976 | Varda | 299/86 |
| 3,997,011 | 12/1976 | Staroba | 175/410 |
| 4,216,832 | 8/1980 | Stephenson | 175/410 |

FOREIGN PATENT DOCUMENTS

| | | | |
|---|---|---|---|
| 262916 | 7/1968 | Austria | 175/410 |
| 2846744 | 4/1980 | Fed. Rep. of Germany | 175/410 |
| 751991 | 2/1978 | U.S.S.R. | 299/86 |

*Primary Examiner*—Stephen J. Novosad
*Assistant Examiner*—Mark J. DelSignore
*Attorney, Agent, or Firm*—Robert E. Walter

[57] ABSTRACT

A rotatable cutting insert of the type having a shank depending from a head portion and having a hard insert mounted therein, includes an improved insert having a conically shaped tip section, a base section and an intermediate section with the maximum diameter of the tip section smaller than the diameter of the base section.

15 Claims, 3 Drawing Figures

ROTATABLE CUTTING BIT

FIELD OF INVENTION

The present invention relates to a rotatable cutting bit of the type having a head portion and depending shank.

BACKGROUND OF INVENTION

Bits that are used in mining and for removing road surfaces are typically mounted in a machine having a power driven cutter wheel. The wheel has an array of cutter bits mounted on the rim which attack the material to be broken.

It is desirable to have the bits rotate in their sockets to permit wear on the bit to be distributed evenly so as to maintain sharpness.

SUMMARY OF THE INVENTION

In accordance with the present invention there is provided, a rotatable cutting bit comprising a head portion, a shank portion depending from said head portion along a longitudinal axis, said head portion having a socket at the foward end, a hard insert having coaxially aligned and integral sections, said sections comprising a base section, and an intermediate section contiguous said base and tip section, said base being fixedly mounted in said socket and having a first diameter, said tip section being conically shaped and having a maximum second diameter; said intermediate section having a maximum third diameter, said second and third diameter being less than said first diameter, said intermediate section and said base forming a fillet at the junction thereof whereby said base forms a shoulder with said intermediate section.

The point attack bit of the present invention is especially useful for removing layers of asphaltic concrete from roadways. Asphaltic concrete is very abrasive and causes excessive steel body wear around the tip. Thus, small bullet type carbide tips would tend to lose support from around the tip causing the tip to fall out.

Tips presently used for this purpose are conically shaped from tip to base. The base has diameter of about five eighths of an inch. As the tip wears during use it becomes blunt and the machine speed is reduced. The present invention obviates the above discussed disadvantages by providing a small diameter tip which reduces blunting so that machine speed is maintained while being firmly held by the head of the bit during cutting.

DRAWINGS

DETAILED DESCRIPTION

Figure 1:
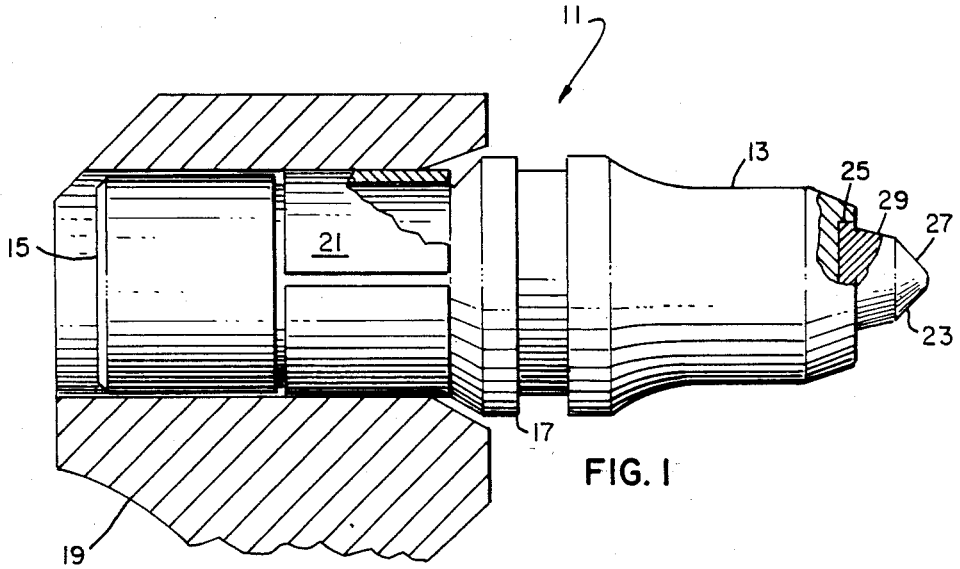
FIG. 1 is a partially sectioned view of a bit mounted in block.
Figure 3:
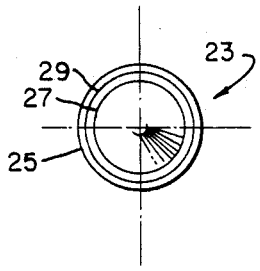
FIG. 3 is an end view of a tip.
Figure 2:
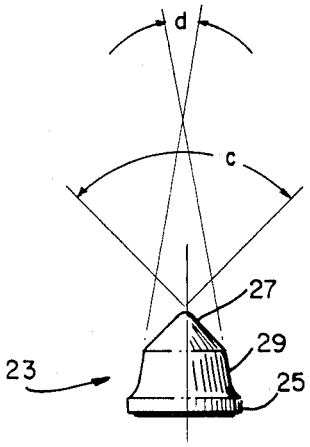
FIG. 2 is a side view of a tip.

Referreing to the drawings, FIG. 1 shows a rotatable bit 11 having a head portion 13 and a depending shank portion 15. The head portion 13 and shank 15 are coaxially aligned with the head 13 having an enlarged section 17 which prevents the head 13 from being forced into the opening in the mounting block 19. The shank portion 15 which is a cylindrical configuration includes a sleeve 21 which is radially contracted when present in the opening so as to hold the bit 11 in the block 19.

A hard insert 23 typically made of a carbide material is fixedly secured to the forward end of the head 13.

Preferably the base section 25 of the insert 23 is positioned in the socket and brazed in such a manner that the braze flows over and around the base section 25.

In accordance with the principals of the present invention, the insert 23 includes a plurality of sections coaxially aligned with the head 13 and shank 15 of the bit 11. The sections include a base section 25, a tip section 27 and an intermediate section 29 contiguous to the base 25 and tip section 27.

The tip section 27 tapers outwardly at an included angle "c" of from about 83 degrees to about 93 degrees, preferably the angle, is about 88 degrees. The point portion of the tip may be rounded to promote even wearing. Preferably the tip 27 extends downwardly in an axial direction toward the base 25 a distance of from about 0.10 to about 0.15 inches. The maximum diameter of the tip 27 is from about 0.36 to about 0.44 inch, and most preferably about 0.4 inch.

The intermediate section 29 extends downwardly from the juncture with the tip 27 or forwardly from the juncture with the base 25 along a longitudinal direction a distance of about 0.25 to about 0.31 inches. Preferably the intermediate section 29 which has a fusto-conical shape tapers outwardly to the base section 25 at an included angle "d" of from about 17 to about 23 degrees. The taper is outwardly from the junction with the tip 27 to the junction with the base 25. The intermediate section 29 has a maximum diameter less than the diameter of the base 25.

The base section 25 preferably has a diameter of from about 0.6 to about 0.66 and most preferably about 0.63. The extension of the base 25 in the axial direction or the height of the base is preferably from about 0.05 to about 0.11 and most preferably about 0.08. As illustrated in the drawing, a fillet may be utilized to give a smooth transition form the base to the intermediate setion 29 whereby the base forms a shoulder with the intermediate section 29.

I claim:

1. A rotatable cutting bit comprising a head portion, a shank portion depending from said head portion along a longitudinal axis, said head portion having a socket at the forward end, a hard insert having coaxially aligned and integral sections, said sections comprising a base section, a tip section, and an intermediate section contiguous said base and tip section, said base being fixedly mounted in said socket and having a first diameter, said tip section being conically shaped and having a maximum second diameter, said intermediate section having a maximum third diameter, said second and third diameters each being less than said first diameter, said intermediate section and said base forming a fillet at the juncture thereof whereby said base forms a shoulder with said intermediate section.

2. A rotatable cutting bit according to claim 1 wherein said intermediate section has a frusto-conical shape and tapers outwardly from the junction with the tip section to the junction with the base section.

3. A rotatable cutting bit according to claim 2 wherein substantially all of said intermediate section projects forwardly of the forward end of said head portion.

4. A rotatable cutting bit according to claim 1 wherein said tip section tapers outwardly at an included angle of from about 83 degrees to about 93 degrees.

5. A rotatable cutting bit according to claim 4 wherein said intermediate section extends forwardly along the longitudinal axis from the base section to the tip section a distance of from about 0.25 to about 0.31 inches.

6. A rotatable cutting bit according to claim 5 wherein the base section extends along the longitudinal axis a distance of from about 0.05 to about 0.11.

7. A rotatable cutting bit according to claim 4 wherein said first diameter is from about 0.6 to about 0.66 inches.

8. A rotatable cutting bit according to claim 6 wherein said second diameter is from about 0.38 to about 0.44 inches.

9. A rotatable cutting bit according to claim 6 wherein said intermediate section tapers outwardly from said conical section to said base section at an included angle of from about 17 to about 23 degrees.

10. A rotatable cutting bit according to claim 6 wherein said insert is fixedly held to said head portion by brazing, said braze flowing over and around said base section.

11. A rotatable cutting bit comprising a head portion, a shank portion depending from said head portion along a longitudinal axis, said head portion having a socket at the forward end, a hard insert having coaxially aligned and integral sections, said sections comprising a base section, a tip section, and an intermediate section contiguous said base and tip section, said base being fixedly mounted in said socket and having a first diameter of from about 0.6 to about 0.66 inches, said tip section having a maximum second diameter being from about 0.38 to about 0.44 inches and being conically shaped with an included angle of from about 83 degrees to about 93 degrees, said intermediate section having a maximum third diameter, said second and third diameters each being less than said first diameter, said intermediate section and said base forming a fillet at the junction thereof whereby said base forms a shoulder with said intermediate section.

12. A rotatable cutting bit according to claim 11 wherein said intermediate section has a fusto-conical shape tapering outwardly from the junction with the tip section to the junction with the base section at an included angle of about 17 to about 23 degrees.

13. A rotatable cutting bit according to claim 11 wherein said intermediate section extends forwardly along the longitudinal axis from the base section to the tip section, a distance of from about 0.25 to about 0.31 inches.

14. A rotatable cutting bit according to claim 11 wherein the base section extends along the longitudinal axis a distance of from about 0.05 to about 0.11.

15. A rotatable cutting bit according to claim 11 wherein said insert is fixedly held to said head portion by brazing, said braze flowing over and around said base sections.

* * * * *

UNITED STATES PATENT AND TRADEMARK OFFICE

CERTIFICATE OF CORRECTION

PATENT NO. : B1 4,497,520

DATED : January 17, 1989

INVENTOR(S) : Randall W. Ojanen

It is certified that error appears in the above-indentified patent and that said Letters Patent is hereby corrected as shown below:

Column 1, line 55, change "0.5" to --0.05--;

Column 3, lines 1-4, italicize the phrase "said maximum second and third diameters each being less than said first diameter and said maximum third diameter being larger than said maximum second diameter,";

Column 3, lines 49-51, italicize the phrase "said intermediate section having a maximum third diameter and tapering outwardly away from said tip section toward said base section,".

Signed and Sealed this

Fifteenth Day of June, 1993

*Attest:*

Michael K. Kirk

MICHAEL K. KIRK

*Attesting Officer*

*Acting Commissioner of Patents and Trademarks*

299-86 SR

CCCA3 OR 4,497,520

REEXAMINATION CERTIFICATE (993rd)

United States Patent [19]

Ojanen

[11] B1 4,497,520

[45] Certificate Issued Jan. 17, 1989

[54] ROTATABLE CUTTING BIT

[75] Inventor: Randall W. Ojanen, Bristol, Va.

[73] Assignee: GTE Products Corporation, Stamford, Conn.

Reexamination Request:
No. 90/001,242, May 18, 1987
No. 90/001,451, Feb. 29, 1988

Reexamination Certificate for:
Patent No.: 4,497,520
Issued: Feb. 5, 1985
Appl. No.: 489,990
Filed: Apr. 29, 1983

[51] Int. Cl.[4] ..... E21C 35/18
[52] U.S. Cl. ..... 299/86; 175/410
[58] Field of Search ..... 299/86, 91, 79; 175/410

[56] References Cited

U.S. PATENT DOCUMENTS

| | | | |
|---|---|---|---|
| 2,847,921 | 8/1958 | Heckathorn | 172/699 |
| 3,239,275 | 8/1966 | Belugou | 299/79 |
| 3,268,259 | 8/1966 | Snipe | 299/91 |
| 3,268,260 | 8/1966 | Snipe | 299/91 |
| 3,276,820 | 10/1966 | Ditson | 299/94 |
| 3,356,418 | 12/1967 | Healey et al. | 299/91 |
| 3,361,481 | 1/1968 | Maddock | 299/86 |
| 3,519,309 | 7/1970 | Engle | 299/86 |
| 3,596,724 | 8/1971 | Bechem | 175/331 |
| 3,807,804 | 4/1974 | Kniff | 299/91 |
| 3,830,321 | 8/1974 | McKenry | 175/332 |
| 3,830,546 | 8/1974 | Kniff | 299/86 |
| 3,848,931 | 11/1974 | Swisher | 299/94 |
| 3,997,011 | 12/1976 | Staroba | 175/400 |
| 4,108,260 | 8/1978 | Bozarth | 175/374 |
| 4,201,421 | 5/1980 | DenBesten | 299/86 |
| 4,216,832 | 8/1980 | Stephenson | 172/540 |
| 4,251,109 | 2/1981 | Roepke | 299/12 |
| 4,254,840 | 3/1981 | Shay, Jr. | 175/410 |
| 4,276,788 | 7/1981 | Nederveen | 76/108 |
| 4,334,586 | 6/1982 | Schumacher | 175/374 |
| 4,389,074 | 6/1983 | Greenfield | 299/79 |
| 4,547,020 | 10/1985 | Ojanen | 299/86 |

FOREIGN PATENT DOCUMENTS

| | | |
|---|---|---|
| 1036535 | 7/1966 | United Kingdom . |
| 2846744 | 4/1980 | Fed. Rep. of Germany . |
| 2384574 | 10/1978 | France . |
| 190452 | 7/1964 | Sweden . |
| 191515 | 9/1964 | Sweden . |
| 495436 | 12/1975 | U.S.S.R. . |
| 829917 | 5/1981 | U.S.S.R. . |
| 899916 | 1/1982 | U.S.S.R. . |
| 1110495 | 4/1968 | United Kingdom . |
| 1112446 | 5/1968 | United Kingdom . |
| 1294717 | 11/1972 | United Kingdom . |
| 1601470 | 8/1981 | United Kingdom . |

OTHER PUBLICATIONS

"Stress Concentration Design Factors", R. E. Peterson, 1953.
Advertisement "One of our Proudest Achievements", Kennametal, 1979.
Advertisement "It's Arrived" Colliery Guardian, vol. 205, No. 5294, Oct. 4, 1962.
"Creating with Metal Powders", Hoeganaes Corp., 1971, Chapter 4.
"Designing with Kennametal" Kennametal, Inc., 1978.
"Elements of Physical Metallurgy", A. G. Guy, pp. vii–ix & pp. 299–301; 1951, 1959.
"Instant Assay Tool for Prospectors", Mining Journal, Apr. 2, 1965, p. 250.
Webster's New Collegiate Dictionary, 1977, pp. 29 and 1161.
Smith Mining Tools Brochure "Conical Mining Bits", pp. 4–6, Oct. 1982.
V. R. Wesson Brochure, "Mining Bits", p. 4, Jan. 1967.
George H. De Groat publication, "Tooling for Metal Powder Parts", pp. 29–50, (1958).
Hoagenaes Corporation publication, "Creating with Metal Powders", pp. 1–52, (1971).
Kennametal Publication, "Construction Tools"(1977).
Kennametal Publication, "Construction Tools"(1975).
Kennametal Publication, "Call us for . . . "(1976).
Kennametal Publication, "designing with Kennametal", pp. 1–50 (1978).
"Schneidende Bewinnung auf der Bergbau 81", *Glückauf*, vol. 117, No. 18, Sep. 1981, pp. 1167–1169.
1975 *Kennametal* catalog, p. 8, 1975.
1977 *Kennametal* catalog excerpt, one page 1977.
1979 *Kennametal* catalog excerpt, one page 1979.

*Primary Examiner*—Jerome W. Massie

[57] ABSTRACT

A rotatable cutting insert of the type having a shank depending from a head portion and having a hard insert mounted therein, includes an improved insert having a conically shaped tip section, a base section and an intermediate section with the maximum diameter of the tip section smaller than the diameter of the base section.

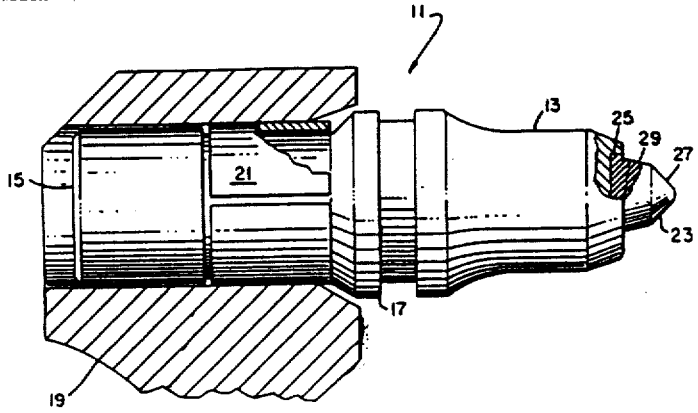

REEXAMINATION CERTIFICATE ISSUED UNDER 35 U.S.C. 307

THE PATENT IS HEREBY AMENDED AS INDICTED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3, 6, 11, 12 and 14 are determined to be patentable as amended.

Claims 4, 5, 7–10, 13 and 15, dependent on an amended claim, are determined to be patentable.

New claims 16–36 are added and determined to be patentable.

1. A rotatable cutting bit comprising a head portion, a shank portion depending from said head portion along a longitudinal axis, said head portion having a socket at the forward end, a hard insert having coaxially aligned and integral sections, said sections comprising a base section, a tip section, and an intermediate section contiguous said base and tip section, said base being fixedly mounted in said socket and having a first diameter, said tip section being conically shaped and having a maximum second diameter, said intermediate section having a maximum third diameter, said second and third diameters each being less than said first diameter,

*said intermediate section having a frusto-conical shape and tapering outwardly from the junction with the tip section to the junction with the base section,* said intermediate section and said base forming a fillet at the juncture thereof whereby said base forms a shoulder with said intermediate section.

2. A rotatable cutting bit according to claim 1 wherein said [intermediate section has a frusto-conical shape and tapers outwardly from the junction with the tip section to the junction with the base section] *insert is fixedly held to said head portion by brazing, said braze flowing over and around said base section.*

3. A rotatable cutting bit according to claim [2] *1* wherein substantially all of said intermediate section projects forwardly of the forward end of said head portion.

6. A rotatable cutting bit according to claim 5 wherein the base section extends along the longitudinal axis a distance of from about 0.5 to about 0.11 *inches.*

11. A rotatable cutting bit comprising a head portion, a shank portion depending from said head portion along a longitudinal axis, said head portion having a socket at the forward end, a hard insert having coaxially aligned and integral sections, said sections comprising a base section, a tip section, and an intermediate section contiguous said base and tip section, said base being fixedly mounted in said socket and having a first diameter of from about 0.6 to about 0.66 inches, said tip section having a maximum second diameter being from about 0.38 to about 0.44 inches and being conically shaped with an included angle of from about 83 degrees to about 93 degrees, said intermediate section having a maximum third diameter *and tapering outwardly away from said tip section toward said base section,* said *maximum* second and third diameters each being less than said first diameter *and said maximum third diameter being larger than said maximum second diameter,* said intermediate section and said base forming a fillet at the junction thereof whereby said base forms a shoulder with said intermediate section.

12. A rotatable cutting bit [according to claim 11 wherein] *comprising a head portion, a shank portion depending from said head portion along a longitudinal axis, said head portion having a socket at the forward end, a hard insert having coaxially aligned and integral sections, said sections comprising a base section, a tip section, and an intermediate section contiguous said base and tip section, said base being fixedly mounted in said socket and having a first diameter of from about 0.6 to about 0.66 inches, said tip section having a maximum second diameter being from about 0.38 to about 0.44 inches and being conically shaped with an included angle of from about 83 degrees to about 93 degrees,* said intermediate section having [has] a [fusto-conical] *frusto-conical* shape tapering outwardly from the junction with the tip section to the junction with the base section at an included angle of about 17 to about 23 degrees *and having a maximum third diameter, said second and third diameter each being less than said first diameter, said intermediate sections and said base forming a fillet at the junction thereof whereby said base forms a shoulder with said intermediate section.*

14. A rotatable cutting bit according to claim 11 wherein the base section extends along the longitudinal axis a distance of from about 0.05 to about 0.11 *inches.*

*16. A rotatable cutting bit according to claim 1 wherein substantially all of said intermediate section projects forwardly of the forward end of said head portion.*

*17. A rotatable cutting bit according to claim 16 wherein said second diameter is from about 0.38 to about 0.44 inches.*

*18. A rotatable cutting bit according to claim 16 wherein said intermediate section tapers outwardly from said tip section to said base section at an included angle of from about 17 to about 23 degrees.*

*19. A rotatable cutting bit according to claim 16 wherein said insert is fixedly held to said head portion by brazing.*

*20. A rotatable cutting bit comprising:*

*a head portion,*

*a shank portion depending from said head portion along a longitudinal axis, said shank portion including means adapted for rotatably holding said bit, said head portion having a socket at the forward end,*

*a hard insert comprising a carbide material, said hard insert having coaxially aligned and integral sections,*

*said sections comprising a base section, a tip section, and an intermediate section contiguous said base and tip section,*

*wherein substantially all of said intermediate section projects forwardly of the forward end of said head portion,*

*said base section being fixedly mounted in said socket by brazing and having a first diameter,*

*said tip section being conically shaped and having a maximum second diameter,*

*said intermediate section having a maximum third diameter and tapering outwardly away from said tip section toward said base section,* said maximum second and third diameters each being less than said first diameter and said maximum third diameter being larger than said maximum second diameter,

*said intermediate section and said base section forming a fillet at the juncture thereof, whereby said base section forms a shoulder with said intermediate section.*

*21. A rotatable cutting bit according to claim 20 wherein said intermediate section has a frusto-conical shape and tapers outwardly from the tip section.*

*22. A rotatable cutting bit according to claim 20 wherein said intermediate section tapers outwardly from said tip section at an included angle of from about 17 to about 23 degrees.*

*23. A rotatable cutting bit according to claim 20 wherein said tip section tapers outwardly at an included angle of from about 83 degrees to about 93 degrees.*

*24. A rotatable cutting bit according to claim 20 wherein said intermediate section extends forwardly along the longitudinal axis from the base section to the tip section a distance of from about 0.25 to about 0.31 inches.*

*25. A rotatable cutting bit according to claim 20 wherein said first diameter is from about 0.6 to about 0.66 inches.*

*26. A rotatable cutting bit according to claim 20 wherein said second diameter is from about 0.38 to about 0.44 inches.*

*27. A rotatable cutting bit comprising*

*a head portion,*

*a shank portion depending from said head portion along a longitudinal axis, said head portion having a socket at the forward end,*

*a hard insert having coaxially aligned and integral sections,*

*said sections comprising a base section, a tip section, and an intermediate section contiguous said base and tip section,*

*said base being fixedly mounted in said socket and having a first diameter of from about 0.6 to about 0.66 inches,*

*said tip section being conically shaped and tapering outwardly at an included angle of from about 83 degrees to about 93 degrees and having a maximum second diameter,* said intermediate section having a maximum third diameter and tapering outwardly away from said tip section toward said base section,

*said maximum second and third diameters each being less than said first diameter and said maximum third diameter being larger than said maximum second diameter,*

*said intermediate section and said base forming a fillet at the juncture thereof whereby said base forms a shoulder with said intermediate section.*

*28. A rotatable cutting bit according to claim 27 wherein said intermediate section extends forwardly along the longitudinal axis from the base section to the tip section a distance of from about 0.25 to about 0.31 inches.*

*29. A rotatable cutting bit according to claim 27, wherein said intermediate section tapers outwardly from said conical section to said base section at an included angle of from about 17 to about 23 degrees.*

*30. A rotatable cutting bit according to claim 27, wherein said second diameter is from about 0.38 to about 0.44 inches.*

*31. A rotatable cutting bit according to claim 1, 11, or 27 wherein said insert is fixedly held to said head portion by brazing.*

*32. A rotatable cutting bit comprising*

*a head portion,*

*a shank portion depending from said head portion along a longitudinal axis,*

*said head portion having a socket at the forward end,*

*a hard insert having coaxially aligned and integral sections,*

*said sections comprising a base section, a tip section and an intermediate section contiguous said base section and tip section,*

*said base being fixedly mounted in said socket and having a first diameter of from about 0.6 to about 0.66 inches,*

*said tip section having a maximum second diameter being from about 0.38 to about 0.44 inches and being conically shaped with an included angle of from about 83 degrees to about 93 degrees,*

*said intermediate section having a maximum third diameter and tapering outwardly away from said tip section toward said base section,*

*said maximum second and third diameters each being less than said first diameter and said maximum third diameter being larger than said maximum second diameter,*

*said intermediate section and said base forming a fillet at the junction thereof whereby said base forms a shoulder with said intermediate section.*

*33. A rotatable cutting bit according to claim 32 wherein substantially all of said intermediate sections projects forwardly of the forward end of said head portion.*

*34. A rotatable cutting bit according to claim 32 wherein said intermediate section has a frusto-conical shape.*

*35. A rotatable cutting bit according to claim 32 wherein said intermediate section extends forwardly along the longitudinal axis from the base section to the tip section, a distance of about 0.25 to about 0.31 inches.*

*36. A rotatable cutting bit according to claim 32 wherein the insert is fixedly held to the head portion by brazing.*

* * * * *